US006176058B1

(12) United States Patent
Trarup

(10) Patent No.: US 6,176,058 B1
(45) Date of Patent: Jan. 23, 2001

(54) REINFORCING DEVICE FOR WOOD BEAMS WITH END SPLITS

(75) Inventor: Glenn M. Trarup, Port Coquitlam (CA)

(73) Assignee: Landmark Truss & Lumber Inc., Abbotsford (CA)

( * ) Notice: Under 35 U.S.C. 154(b), the term of this patent shall be extended for 0 days.

(21) Appl. No.: 09/307,707

(22) Filed: May 10, 1999

(51) Int. Cl.[7] ..... E04C 3/12

(52) U.S. Cl. ..... 52/514; 52/696; 52/DIG. 6; 52/DIG. 7; 52/737.3

(58) Field of Search ..... 52/514, 696, 712, 52/DIG. 6, 737.3, DIG. 7; 403/283; 411/468, 470, 471, 472, 473, 474, 466

(56) References Cited

U.S. PATENT DOCUMENTS

| | | | | |
|---|---|---|---|---|
| D. 202,925 | | 11/1965 | Mort . | |
| 2,470,514 | | 5/1949 | Muller . | |
| 3,094,748 | * | 6/1963 | Sanford | 411/465 |
| 3,234,841 | * | 2/1966 | Adams | 411/467 |
| 4,442,649 | | 4/1984 | Birchkead et al. . | |
| 4,637,194 | | 1/1987 | Knowles . | |
| 4,710,083 | * | 12/1987 | Wolf | 411/466 |
| 5,116,179 | * | 5/1992 | Matlock | 411/466 |
| 5,234,279 | * | 8/1993 | Poutanen | 403/403 |
| 5,551,819 | | 9/1996 | Stern . | |
| 5,553,961 | * | 9/1996 | Olden | 403/119 |
| 5,896,716 | | 4/1999 | Jalla . | |

FOREIGN PATENT DOCUMENTS

| | | |
|---|---|---|
| 613247 | 9/1979 | (CH) . |

* cited by examiner

*Primary Examiner*—Christopher T. Kent
*Assistant Examiner*—Jennifer I. Thissell
(74) *Attorney, Agent, or Firm*—Banner & Witcoff, Ltd.

(57) ABSTRACT

A reinforcing plate is attached to an end-split wood beam covering at least a portion of the end split. The reinforcing plate inhibits the end split from propagating toward the middle portion of the wood beam. According to one aspect of the invention, the reinforcing plate increases the grade of the wood beam. According to another aspect of the invention, the reinforcing plate prevents or substantially avoids downgrading of the wood beam. The reinforcing plate preferably is steel and has teeth which are angled relative to the grain of the wood. First and second portions of the teeth preferably are oriented oppositely from one another, i.e., 90° relative to one another.

21 Claims, 3 Drawing Sheets

REINFORCING DEVICE FOR WOOD BEAMS WITH END SPLITS

FIELD OF THE INVENTION

The present invention is directed to dimensional lumber and, more particularly, to end-split wood beams which are reinforced to inhibit the end splits from propagating toward the middle of the wood beam.

BACKGROUND OF THE INVENTION

End splitting is a phenomenon associated with the drying and shrinking processes of wood and is a common defect in dimensional lumber. End splitting occurs when the ends of a board dry at a faster rate than the interior region. This higher moisture content gradient at the ends of the beam results in differential shrinkage. When the tensile strength perpendicular to the grain is exceeded, an end split forms.

The incidence of end splits typically increases as the depth of the wood increases. For example, dimensional 2×10 and 2×12 lumber have a higher occurrence of end splits when compared to 2×4 and 2×6 lumber. End splits also are more common on the higher-density species of wood such as Douglas Fir, and less common on lower-density species such as Spruce and Pine. On average, about 20% of a quantity of dimensional lumber will have end splits.

The moisture content of lumber varies and is dependent on its exposure to weather. End splits can occur in a piece of lumber at any time, i.e., during the period from initial milling up until the time the piece reaches moisture content equilibrium in its final structure. An end split can start small and become longer, propagating toward the middle of the piece of lumber.

As end splits are a common defect in lumber, specified lengths of end splits are permitted by lumber grading rules. Typically, the higher the grade of lumber, the smaller the allowable end split. Indeed, the grade of a piece of lumber can be governed by an end split. For example, a piece of lumber which is Select Structural grade in all respects except for the permissible length of an end split, could be downgraded to a No. 3 grade.

Plates have been applied to composite wood beams to increase shear capacity. For example, Knowles U.S. Pat. No. 4,637,194 describes applying shear stress plates to opposite faces of a web of a wooden I-beam near the ends of the beam. The plates may be formed of a plywood and secured to the web by means of nails, staples, adhesive, or a combination thereof. The shear stress plates are said to increase the thickness of the web only in the shear-field or area needed. Alternately, a stiff metal plate may be used, similar to that used in the truss industry. The metal plates are said to reinforce the ends of the web in a manner similar to thickening the ends of the web in the area or field of maximum shear stress.

The shear plates disclosed by Knowles function by the classical formula for calculating maximum longitudinal shear capacity of wood beam:

$$V=\tfrac{2}{3}Af_v$$

V=maximum shear force

A=cross-sectional area of wood beam $f_v$=allowable unit shear stress of wood

From this classical formula, the maximum shear force in a wood beam is directly proportional to the cross-sectional area of the beam. Based on the uniform shear stress distribution shown in FIG. 14 of Knowles, it is apparent that no consideration was given to the end split condition. The classical formula described by Knowles is not valid for end-split lumber, which does not have a uniform shear stress distribution.

The use of metal plates also is disclosed by Birckhead U.S. Pat. No. 4,442,649, wherein a fabricated wooden beam has at least two longitudinal wooden members spaced parallel and apart by a plurality of wooden blocks spaced between and along the length of the longitudinal members. A plurality of truss plates, each installed across one side of a block and spanning between each longitudinal member, are said to provide structural integrity. The truss plates may be installed in pairs with one across either face of each block at an acute angle, i.e., a 45° angle, to the longitudinal axis of the beam. Narrow truss plates may be provided at each end, tieing the ends of the longitudinal members and the end block more securely together.

Although Knowles and Birckhead describe applying shear plates to composite wood beams to increase shear capacity and/or assemble the composite wood beams, neither reference addresses the use of lumber with end splits or the problem of inhibiting end splits from propagating in dimensional lumber to upgrade or avoid downgrading of the lumber.

SUMMARY OF THE INVENTION

According to one aspect of the present invention, lowering of the grade of a piece of end-split lumber to a lesser grade is prevented or substantially avoided by inhibiting the propagation of the end split. The propagation of the end split is inhibited by attaching at least one reinforcing plate to the piece of lumber covering at least a portion of the end split.

According to another aspect of the invention, the grade of a piece of end-split lumber can be increased by attaching at least one reinforcing plate to the piece of lumber covering at least a portion of the end split. The reinforcing plate nullifies the effects of the end split which otherwise would result in the piece of lumber being assigned a lesser grade.

The reinforcing plate preferably is steel and has teeth which are angled relative to the grain of the wood. In a preferred embodiment, first and second portions of the teeth are oriented oppositely from one another, i.e., 90° relative to one another.

BRIEF DESCRIPTION OF THE DRAWINGS

The present invention will now be described in more detail with reference to preferred embodiments of the invention, given only by way of example, and illustrated in the accompanying drawings in which.

DETAILED DESCRIPTION OF THE INVENTION

Figure 1:
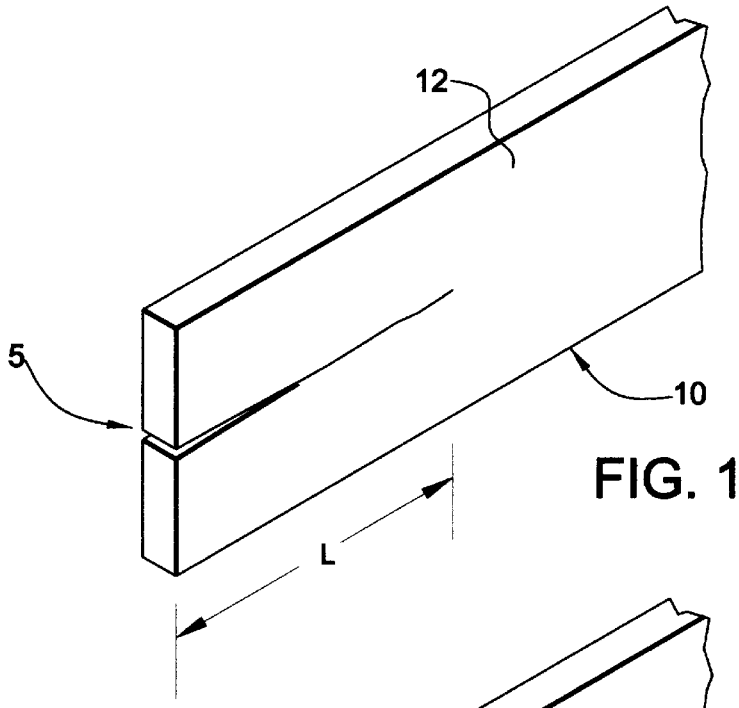
FIG. 1 illustrates a perspective view of a wood beam with an end split.
Figure 2:
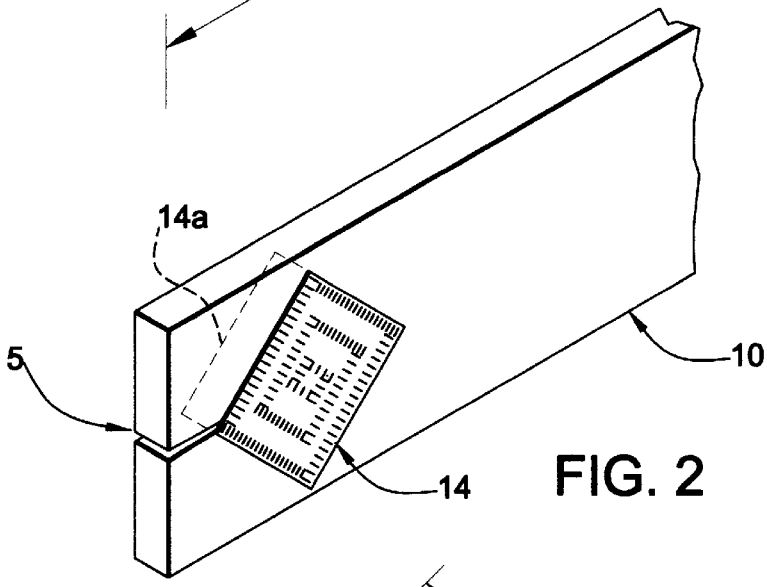
FIG. 2 illustrates a perspective view of an end-split wood beam with a reinforcing plate installed on the face of the beam.

With reference to FIGS. 1–2, a unitary wood beam 10 comprises a length of wood 12 having an end split 5 at one or both ends. A reinforcing plate 14 is secured to a face of the wood beam 10 covering at least a portion of the end split 5. The reinforcing plate 14 inhibits the end split 5 from propagating toward the middle portion of the wood beam 10. The reinforcing plate 14 also functions to increase the longitudinal shear capacity of the wood beam 10. The reinforcing plate 14 preferably is metal, e.g., steel, and has teeth 20 which penetrate the wood beam 10.

Either a single reinforcing plate 14 may be attached to the end-split wood beam 10, or alternately, first 14 and second 14*a* reinforcing plates may be attached to the wood beam 10 on opposite faces thereof. An optional second reinforcing plate 14*a* is illustrated in broken lines in FIG. 2. The second reinforcing plate 14*a* further inhibits the end split 5 from propagating toward the middle of the wood beam 10.

According to one aspect of the present invention, lowering of the grade of a piece of end-split lumber (e.g., wood beam 10) to a lesser grade is prevented or substantially avoided by inhibiting the propagation of the end split 5. For example, attaching a reinforcing plate 14 to a wood beam 10 which qualifies for a No. 1 grade in all respects and which has an end split 5 of permissible length L, inhibits the end split 5 from propagating to a length which would downgrade the wood beam 10 to a No. 2 or a No. 3 grade.

According to another aspect of the invention, the grade of a piece of end-split lumber (e.g., wood beam 10) can be increased by attaching at least one reinforcing plate 14 to the piece of lumber covering at least a portion of the end split 5. For example, attaching a reinforcing plate 14 to a wood beam 10 which qualifies as a Select Structural grade in all respects except for having an end split 5 of a length L which otherwise would downgrade the wood beam 10 to a No. 2 grade, nullifies the effects of the end split 5 and increase s the grade of the wood beam 10 to Select Structural.

The maximum allowable end split length for Structural Joists and Planks in accordance with the NLGA Standard Lumber Grading Rules is set forth in Table 1.

TABLE 1

Maximum Permitted End Split Length

| Lumber Grade | Maximum Permitted End Split Length |
|---|---|
| Select Structural | width of piece |
| No. 1 | width of piece |
| No. 2 | 1.5 × width of piece |
| No. 3 | ⅙ × length of piece |

The reinforcing plate 14 preferably has teeth 20 which are angled relative to the grain of the wood. Preferably, the reinforcing plate 14 is positioned on the wood beam 10 such that the teeth 20 are at about a 45° angle relative to the longitudinal axis A of the wood beam 10. A conventional reinforcing plate 30, illustrated in FIGS. 3C and 3D, may be used as a reinforcing plate 14 in accordance with the invention. The first 14 and second 14*a* reinforcing plates may be positioned such that their teeth 20 are oriented oppositely from one another, i.e., 90° relative to one another.

Figure 3A:
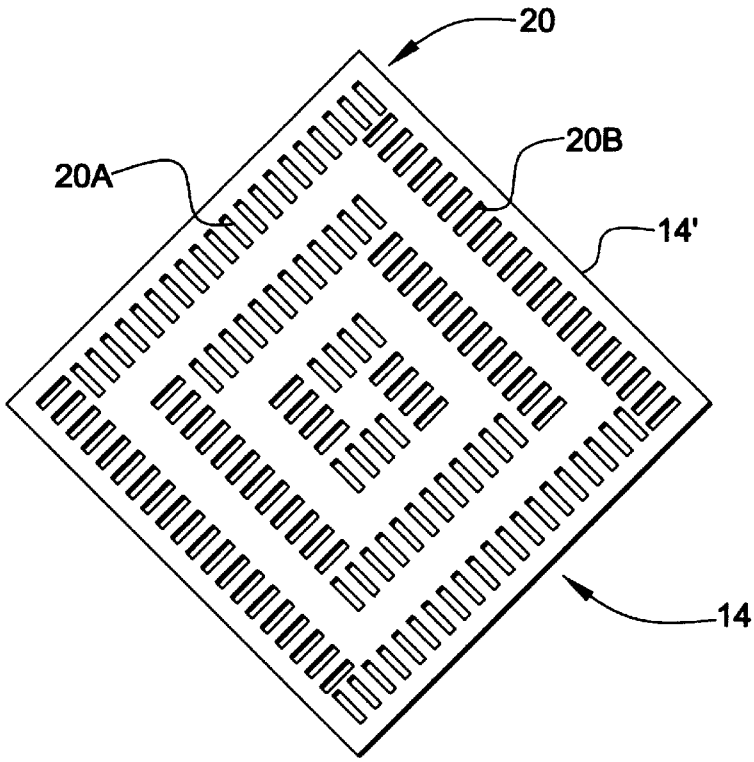
FIGS. 3A and 3B illustrate reinforcing plates having preferred tooth configurations according to the present invention.
Figure 3B:
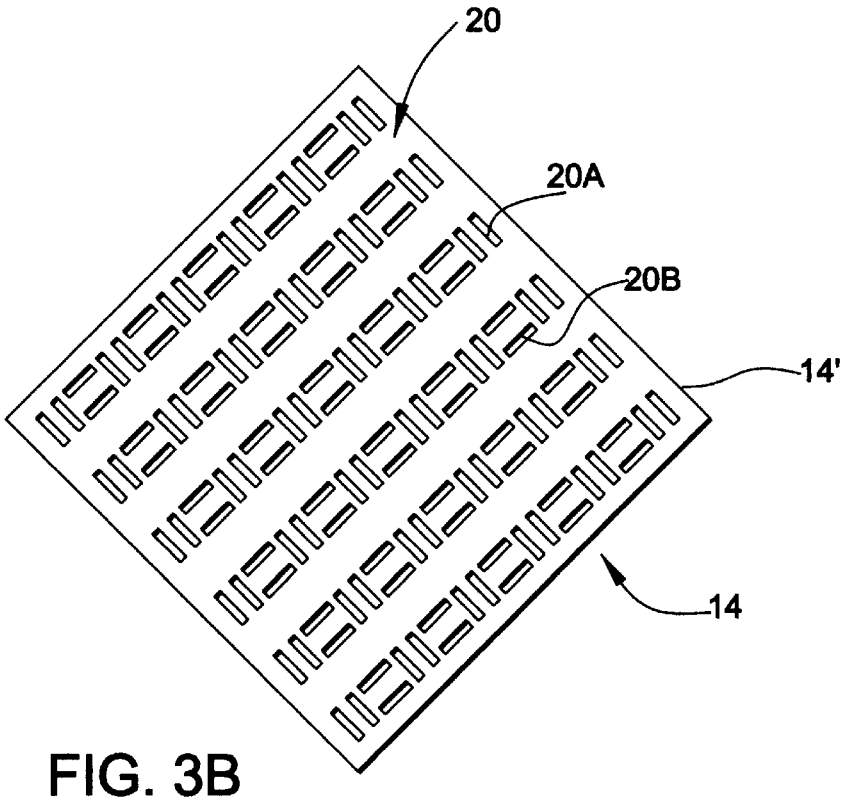
Figure 3C:
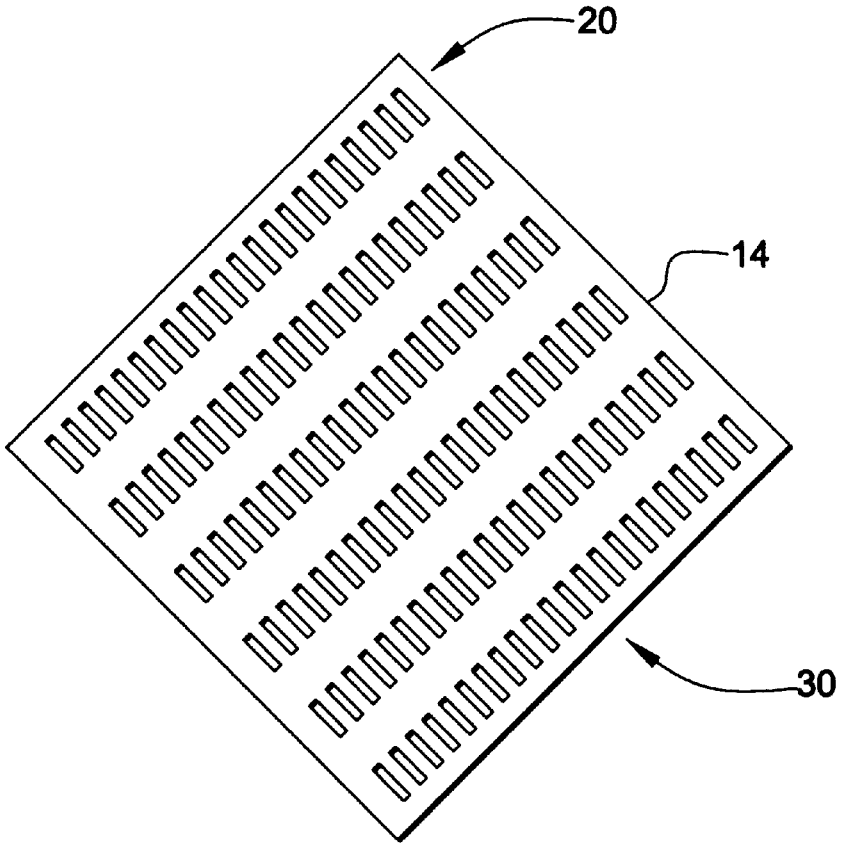
FIG. 3C PRIOR ART
FIG. 3C illustrates a conventional reinforcing plate which may be used in accordance with the invention.
Figure 3D:
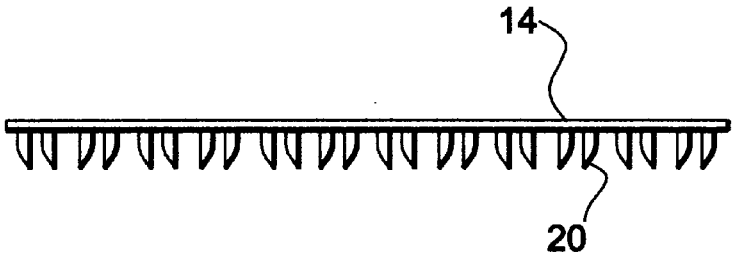
FIG. 3D PRIOR ART
FIG. 3D is a side view of the conventional reinforcing plate of FIG. 3C.

According to a preferred embodiment of the invention, the teeth 20 on each reinforcing plate 14, 14*a* are oriented as illustrated in FIGS. 3A or 3B. A first portion (about one-half) of teeth 20A are oriented substantially parallel to a first side edge 14' of the reinforcing plate 14, and a second portion of the teeth 20B are oriented substantially perpendicular to the first side edge 14' of the reinforcing plate 14. This configuration enables the reinforcing plate 14 to inhibit the propagation of end splits most effectively.

Figure 4:
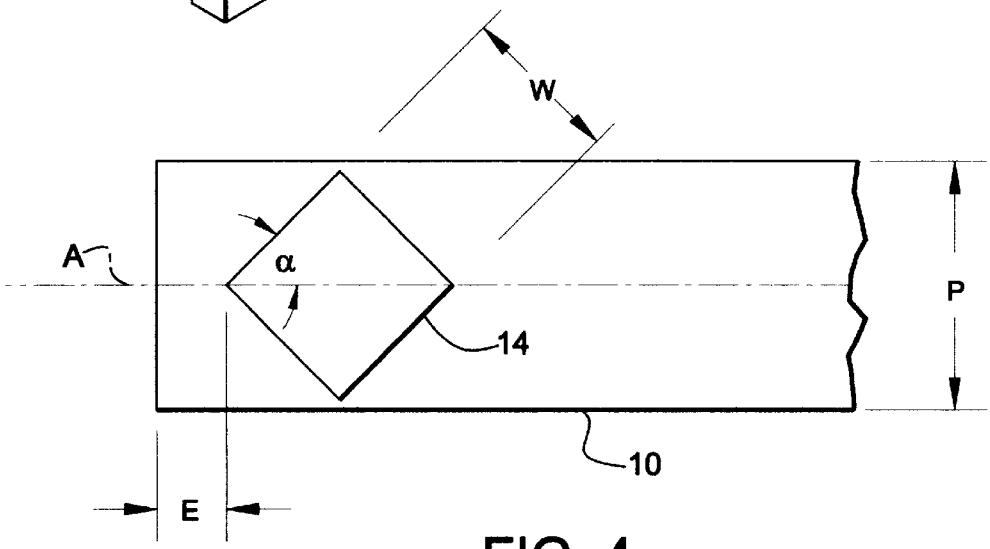
FIG. 4 illustrates preferred dimensional relationships of the reinforcing plate with respect to the end-split wood beam.

With reference to FIG. 4, the reinforcing plate 14 preferably is rectangular, more preferably square in shape, and is oriented such that its edges are at about a 45° angle $\alpha$ relative to the longitudinal axis A of the wood beam 10. The width W of the reinforcing plate may be suitably selected according to the depth P of the beam. Preferably, W is selected such that:

$$W=kP$$

where k is a constant having a value from about 0.6 to about 0.7, and typically is about 0.65. The value of k also is dependent on the tooth design of the reinforcing plate. For example, a conventional toothed plate 30, shown in FIG. 3C, typically would have a k value at or near the high end of the range. Optimized reinforcing plates 14 according to a preferred embodiment of the invention, as illustrated in FIG. 3A and FIG. 3B, typically have a k value at or near the low end of the range.

The location of the reinforcing plate 14 on the end of the wood beam 10 may be determined according to the desired grade of the wood beam 10. The dimension E as shown in FIG. 4 preferably is selected as ½ of the maximum permitted end split length for the desired lumber grade, as summarized in Table 2.

TABLE 2

Reinforcing Plate Location

| Lumber Grade | Plate Location Dimension E |
|---|---|
| Select Structural | 0.5 × width of piece |
| No. 1 | 0.5 × width of piece |
| No. 2 | 0.75 × width of piece |
| No. 3 | 1/12 × length of piece |

While particular embodiments of the present invention have been described and illustrated, it should be understood that the invention is not limited thereto since modifications may be made by persons skilled in the art. The present application contemplates any and all modifications that fall within the spirit and scope of the underlying invention disclosed and claimed herein.

What is claimed is:

1. A process of inhibiting the propagation of an end split in a wood beam comprising:

providing a wood beam having a first end, a middle portion, and a second end, wherein at least one of said first end and said second end has an end split; and attaching a first reinforcing plate to a first side face of said wood beam covering at least a portion of said end split;

whereby said first reinforcing plate inhibits said end split from propagating toward said middle portion of said wood beam and prevents downgrading of said wood beam.

2. The process of claim 1 wherein attaching said first reinforcing plate increases the grade of said wood beam.

3. The process of claim 1 further comprising attaching a second reinforcing plate to a second side face of said wood beam opposite to said first reinforcing plate, said second reinforcing plate covering at least a portion of said end split.

4. The process of claim 3 wherein attaching said first reinforcing plate and said second reinforcing plate increases the grade of said wood beam.

5. The process of claim 1 wherein said first reinforcing plate is spaced from said first end by a predetermined distance.

6. A process of inhibiting the propagation of an end split in a wood beam comprising:

providing a wood beam having a first end, a middle portion, and a second end, wherein at least one of said first end and said second end has an end split; and attaching a first reinforcing plate to said wood beam covering at least a portion of said end split;

whereby said first reinforcing plate inhibits said end split from propagating toward said middle portion of said wood beam and prevents downgrading of said wood beam;

wherein said first reinforcing plate is metal and has a plurality of teeth penetrating into said wood beam;

wherein a first portion of said plurality of teeth are oriented at an acute angle relative to a longitudinal axis of said wood beam, and a second portion of said plurality of teeth are oriented at an obtuse angle relative to the longitudinal axis of said wood beam.

7. The process of claim 6 wherein said first reinforcing plate is rectangular;

wherein said acute angle is about 45°; and wherein said obtuse angle is about 135°.

8. The process of claim 3 wherein each of said first reinforcing plate and said second reinforcing plate is metal and has teeth penetrating into said wood beam;

wherein a first portion of said teeth of each of said first reinforcing plate and said second reinforcing plate are oriented at an acute angle relative to a longitudinal axis of said wood beam, and a second portion of said teeth of each of said first reinforcing plate and second reinforcing plate are oriented at an obtuse angle relative to the longitudinal axis of said wood beam.

9. The process of claim 8 wherein each of said first reinforcing plate and said second reinforcing plate is rectangular; wherein said acute angle is about 45°; and wherein said obtuse angle is about 135°.

10. The process of claim 3 wherein said first end of said wood beam has a first end split and said second end of said wood beam has a second end split, wherein each of said first reinforcing plate and said second reinforcing plate are attached to said first end of said wood beam covering at least a portion of said first end split; the process further comprising:

attaching a third reinforcing plate to said second end of said wood beam, said third reinforcing plate covering at least a portion of said second end split; and attaching a fourth reinforcing plate to said second end of said wood beam opposite to said third reinforcing plate, said fourth reinforcing plate covering at least a portion of said second end split.

11. A reinforced end-split wood beam comprising:

a wood beam having a first end, a middle portion, and a second end; wherein at least one of said first end and said second end has an end split; and a first reinforcing plate attached to a first side face of said wood beam, said first reinforcing plate covering at least a portion of said end split;

whereby said first reinforcing plate inhibits said end split from propagating toward said middle portion of said wood beam and prevents downgrading of said wood beam.

12. The reinforced end-split wood beam of claim 11 wherein said first reinforcing plate increases the grade of said wood beam.

13. The reinforced end-split wood beam of claim 11 further comprising a second reinforcing plate attached to a second side face of said wood beam opposite to said first reinforcing plate, said second reinforcing plate covering at least a portion of said end split.

14. The reinforced end-split wood beam of claim 13 wherein said first reinforcing plate and said second reinforcing plate increase the grade of said wood beam.

15. The reinforced end-split wood beam of claim 11 wherein said first reinforcing plate is spaced from said first end by a predetermined distance.

16. A reinforced end-split wood beam comprising;

a wood beam having a first end, a middle portion, and a second end; wherein at least one of said first end and said second end has an end split; and a first reinforcing plate attached to said wood beam, said first reinforcing plate covering at least a portion of said end split;

whereby said first reinforcing plate inhibits said end split from propagating toward said middle portion of said wood beam and prevents downgrading of said wood beam;

wherein said first reinforcing plate is metal and has teeth penetrating into said wood beam;

wherein a first portion of said teeth are oriented at an acute angle relative to a longitudinal axis of said wood beam, and a second portion of said teeth are oriented at an obtuse angle relative to the longitudinal axis of said wood beam.

17. The reinforced end-split wood beam of claim 16 wherein said first reinforcing plate is rectangular; wherein first acute angle is about 45°; and wherein said obtuse angle is about 135°.

18. The reinforced end-split wood beam of claim 13 wherein each of said first reinforcing plate and said second reinforcing plate is metal and has teeth penetrating into said wood beam;

wherein a first portion of said teeth each of said first reinforcing plate and said second reinforcing plate are oriented at an acute angle relative to a longitudinal axis of said wood beam, and a second portion of said teeth of each of said first reinforcing plate and said second reinforcing plate are oriented at an obtuse angle relative to the longitudinal axis of said wood beam.

19. The reinforced end-split wood beam of claim 18 wherein each of said first reinforcing plate and said second reinforcing plate is rectangular; wherein said acute angle is about 45°; and wherein said obtuse angle is about 135°.

20. The reinforced end-split wood beam of claim 13 wherein said first end of said wood beam has a first end split and said second end of said wood beam has a second end split, wherein each of said first reinforcing plate and said second reinforcing plate are attached to said first end of said wood beam covering at least a portion of said first end split; the reinforced end-split wood beam further comprising:

a third reinforcing plate attached to said second end of said wood beam, said third reinforcing plate covering at least a portion of said second end split; and a fourth reinforcing plate attached to said second end of said wood beam opposite to said third reinforcing plate, said fourth reinforcing plate covering at least a portion of said second end split.

21. A reinforced end-split structural wood beam comprising:

a structural wood beam having a first end, a middle portion, and a second end; wherein at least one of said first end and said second end has an end split; and a first reinforcing plate attached to said wood beam, said first reinforcing plate covering at least a portion of said end split;

whereby said first reinforcing plate inhibits said end split from propagating toward said middle portion of said wood beam and prevents downgrading of said wood beam.

* * * * *